US005202737A

United States Patent [19]

Hollar

[11] Patent Number: 5,202,737

[45] Date of Patent: Apr. 13, 1993

[54] METHOD AND APPARATUS FOR DECURLING SHEETS IN A COPYING DEVICE

[75] Inventor: Thomas C. Hollar, Penfield, N.Y.

[73] Assignee: Xerox Corporation, Stamford, Conn.

[21] Appl. No.: 897,697

[22] Filed: Jun. 12, 1992

[51] Int. Cl.[5] ..... G03G 21/00; B31F 7/00

[52] U.S. Cl. ..... 355/308; 162/271; 355/309

[58] Field of Search ..... 355/308, 309, 315; 162/270, 271

[56] References Cited

U.S. PATENT DOCUMENTS

| | | | |
|---|---|---|---|
| 4,326,915 | 4/1982 | Mutschler | 162/271 |
| 4,475,896 | 10/1984 | Bains | 493/454 |
| 4,505,695 | 3/1985 | Billings | 162/271 X |
| 4,591,259 | 5/1986 | Kuo et al. | 355/309 |
| 4,627,718 | 12/1986 | Wyer | 355/311 |
| 4,632,533 | 12/1986 | Young | 355/309 |
| 4,952,281 | 8/1990 | Akira | 162/270 |
| 4,977,432 | 11/1990 | Coombs et al. | 355/309 |
| 5,141,484 | 8/1992 | Akira | 162/271 X |

*Primary Examiner*—Fred L. Braun

*Attorney, Agent, or Firm*—H. Fleischer; J. E. Beck; R. Zibelli

[57] ABSTRACT

An apparatus in which sheet material is decurled. The apparatus includes a rod deflecting a belt to define a nip therebetween. The belt is entrained about a part of spaced rollers. A pair of baffle plates are located at the entrance to the nip and at the exit to the nip. The rod is adapted to translate in a vertical direction. As the rod translates, the degree of deflection is varied and the bend of the sheet adjusted. The baffle plates at both the exit and entrance regions to the nip pivot in unison with the translation of the pivot rod so as to adjust the orientation of the sheet entering and leaving the nip.

19 Claims, 2 Drawing Sheets

METHOD AND APPARATUS FOR DECURLING SHEETS IN A COPYING DEVICE

Figure 1:
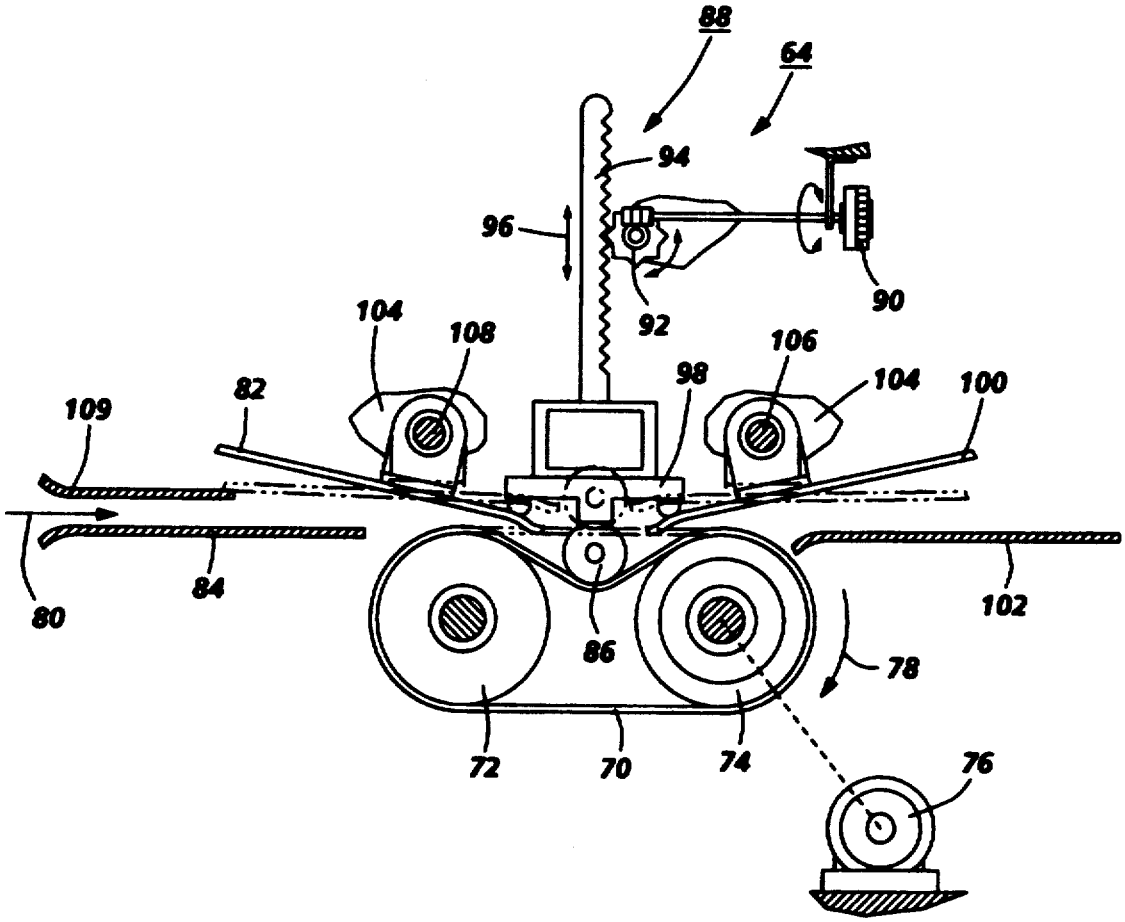

This invention relates generally to an electrophotographic printing machine, and more particularly concerns an apparatus for decurling sheet material employed therein.

Generally, electrophotographic printing comprises charging a photoconductive member to a substantially uniform potential so as to sensitize the surface thereof. The charged portion of the photoconductive surface is exposed to a light image of an original document being reproduced. This records an electrostatic latent image on the photoconductive surface which corresponds to the informational areas contained within the original document. The latent image is developed by bringing a developer material into contact therewith. In this way, a powder image is formed on the photoconductive member which is subsequently transferred to a sheet of support material. The sheet of support material is then heated to permanently affix the powder image thereto. As the sheet of support material passes through the various processing stations in the electrophotographic printing machine, a curl or bend is frequently induced therein. Occasionally, this curl or bend may be inherent in the sheet of support material due to the method of manufacture thereof. It has been found that this curler is variable from sheet to sheet and may depend upon sheet conditions such as moisture content, sheet thickness, etc. The curling of the sheet of support material causes problems of handling as the sheet is processed in the printing machine. Sheets delivered in a curled condition have a tendency to have their edges out of registration with the aligning mechanism employed in the printing machine. In addition, curled sheets tend to frequently produce jams or misfeeds within the printing machine. Hereinbefore, this problem has been resolved by utilizing bars, rollers or cylinders which engage the sheet material as it passes through the printing machine. Frequently, belts or soft rollers are used in conjunction with a hard penetrating roll to remove the curl in the sheet. However, systems of this type have disadvantages. For example, the size of the decurler is not necessarily consistent with that required in the electrophotographic printing machine. In addition, decurlers of this type generally have a high running torque necessitating significant power inputs to operate successfully. Moreover, inasmuch as the degree of penetration or bend is generally fixed, sheets having different thickness and/or weights may require different degrees of penetration in order to successfully remove the curl contained therein.

Various approaches have been devised to improve sheet decurlers. The following disclosures may be relevant to various of the present invention:

U.S. Pat. No. 4,475,896. Patentee: Bains. Issued: Oct. 9, 1984.

U.S. Pat. No. 4,591,259. Patentee: Kuo et al. Issued: May 27, 1986.

U.S. Pat. No. 4,627,718. Patentee: Wyer. Issued: Dec. 9, 1986.

U.S. Pat. No. 4,632,533. Patentee: Young. Issued: Dec. 30, 1986.

The pertinent portions of the foregoing disclosures may be briefly summarized as follows:

U.S. Pat. No. 4,475,896 discloses a rigid penetration roller forming a penetration nip with a compliant roller. The penetration nip is adapted to curl sheets of paper passing therethrough. Movable plates are positioned at the sheet exit side of the nip for controlling the angle of exit of the sheets from the nip. A rack and pinion mechanism is provided for adjusting the orientation of the exit plates.

U.S. Pat. No. 4,591,259 discloses a decurler in which a sheet moving therethrough chooses one of three paths. Spring loaded baffles, in conjunction with idler rolls, reverse bend the sheets in two of the three paths.

U.S. Pat. No. 4,627,718 discloses a sheet curl control apparatus having a pair of rollers in engagement with one another. A set of baffle plates is located at the entrance and exit of the nip defined by the rollers. The sheet is advanced to and from the nip by the baffle plates at an angle so as to cause the sheet to bend as it passes through the nip.

U.S. Pat. No. 4,632,533 discloses a sheet decurler having two paths. A pair of offset rollers are located in each path with the nip being positioned to cause the sheet to bend as it passes therethrough. The offset nip in combination with the output baffle reverse bends the sheet.

In accordance with the features of the present invention, there is provided an apparatus for decurling sheet material. The apparatus includes flexible means for advancing the sheet material. A rod is positioned in contact with the flexible means to define a nip through which the sheet material advances. As the sheet material advances through the nip, it bends about at least a portion of the rod. Means, positioned adjacent the flexible means, guide the sheet material. Means are provided for moving the rod to adjust deflection of the flexible means in the nip to change the bending of the sheet material about the rod. The moving means moves the guiding means and the rod in unison with one another.

Pursuant to another aspect of the present invention, there is provided a method of decurling sheet material. The method includes the steps of advancing the sheet material, and positioning a rod in contact with a belt entrained about a pair of spaced rollers to define a nip therebetween. The rod is interposed between the pair of spaced rollers. As the sheet material advances, it bends about the rod. The sheet material is guided by guide baffles located adjacent the belt. The rod and guide baffles are moved in unison with one another to adjust deflection of the belt in the nip. This changes the bending of the sheet material about the rod and controls the orientation of the advancing sheet material.

Still another aspect of the present invention is a printing machine adapted to produce copies on sheet material advancing through a plurality of processing stations therein. The printing machine includes a fusing apparatus with a sheet decurling apparatus being provided for substantially removing curl in the sheet material exiting the fusing apparatus. The sheet decurling apparatus includes flexible means for advancing the sheet material. A rod is positioned in contact with the flexible means to define a nip through which the sheet material advances. The advancing sheet material bends about at least a portion of the rod. Means, positioned adjacent the flexible means, guide the sheet material. Means are provided for moving the rod to adjust deflection of the flexible means in the nip to change the bending of the sheet material about the rod. The moving means moves the guiding means and the rod in unison with one another.

Figure 2:
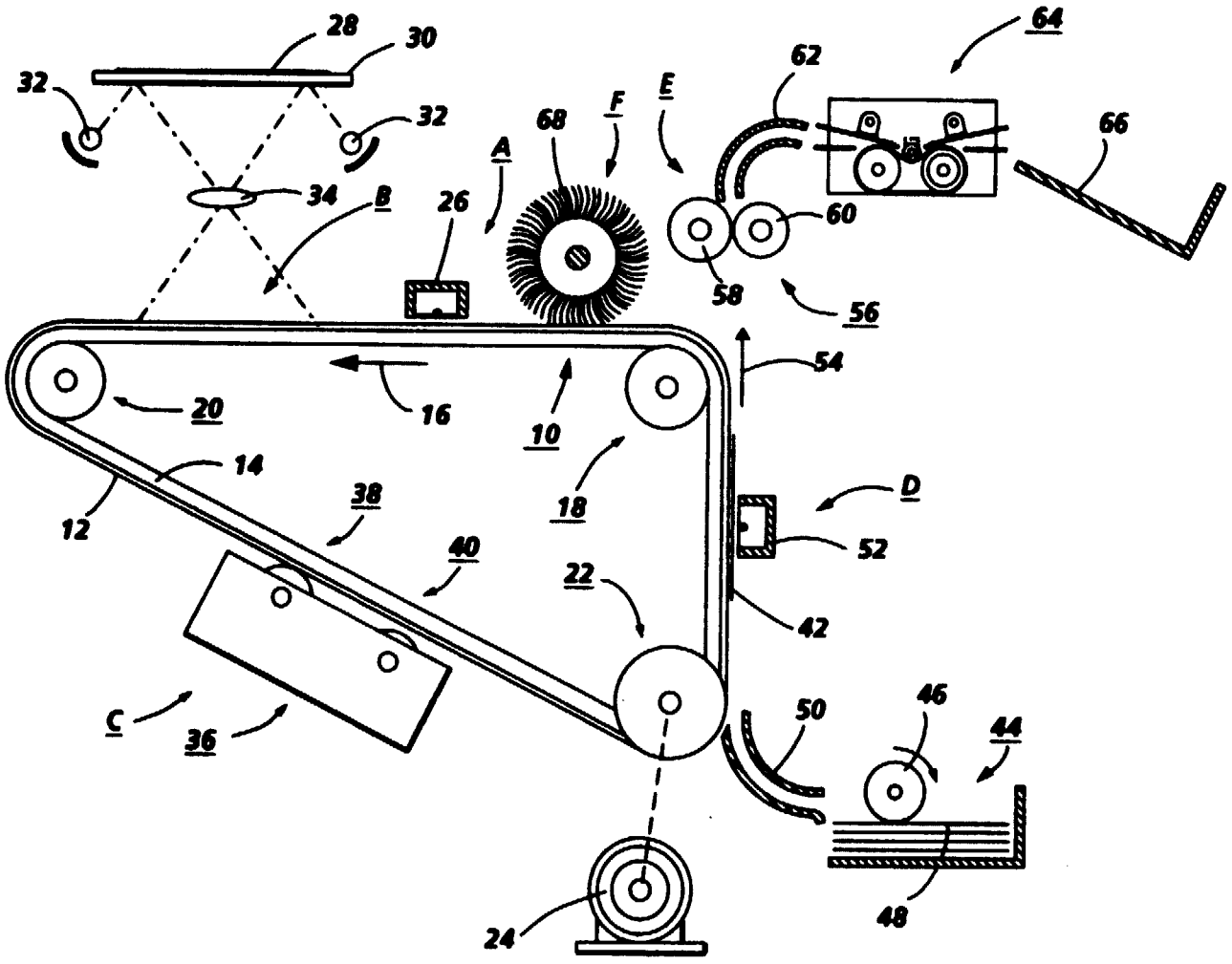

Other aspects of the present invention will become apparent as the following description proceeds and upon reference to the drawings, in which:

FIG. 1 is an elevational view showing the decurling apparatus of the present invention used in the FIG. 2 printing machine; and FIG. 2 is an elevational view illustrating an exemplary electrophotographic printing machine incorporating the features of the FIG. 1 decurling apparatus therein.

While the present invention will hereinafter be described in conjunction with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements. FIG. 2 schematically depicts the various components of an illustrative electrophotographic printing machine incorporating the decurling apparatus of the present invention therein. It will become evident from the following discussion that the decurling apparatus is equally well suited for use in a wide variety of printing machines and is not necessarily limited in its application to the particular embodiment shown herein. In addition, the location of the decurling apparatus, as depicted in the FIG. 2 electrophotographic printing machine may be varied. The decurling apparatus may be positioned intermediate any of the processing stations within the printing machine. In the printing machine depicted in FIG. 2, the decurling apparatus is positioned after the fusing station prior to the catch tray so as to straighten the final copy sheet prior to removal from the printing machine by the operator. However, this location is merely illustrative of the operation of the decurling apparatus and may be varied.

Inasmuch as the art of electrophotographic printing is well known, the various processing stations employed in the FIG. 2 printing machine will be shown hereinafter schematically and their operation described briefly with reference thereto.

As shown in FIG. 2, the electrophotographic printing machine employs a belt 10 having a photoconductive surface 12 deposited on a conductive substrate 14. Preferably, photoconductive surface 12 includes a transport layer having small molecules of m-TBD dispersed in a polycarbonate and a generation layer of triganol selenium. Conductive substrate 14 is made preferably from aluminized Mylar which is electrically grounded. Belt 10 moves in the direction of arrow 16 to advance successive portions of photoconductive surface 12 through the various processing stations disposed about the path of movement thereof. Belt 10 is entrained about stripping roller 18, tension roller 20 and drive roller 22. Drive roller 22 is mounted rotatably and in engagement with belt 10. Roller 22 is coupled to motor 24 by suitable means, such as a belt drive. Motor 24 rotates roller 22 to advance belt 10 in the direction of arrow 16. Drive roller 22 includes a pair of opposed spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 2, initially a portion of belt 10 passes through charging station A. At charging station A, a corona generating device, indicated generally by the reference numeral 26, charges photoconductive surface 12 to a relatively high, substantially uniform potential.

Thereafter, the charged portion of photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Next, belt 10 advances the electrostatic latent image recorded on photoconductive surface 12 to development station C. At development station C, a magnetic brush development system, indicated generally by the reference numeral 36, transports a developer material into contact with photoconductive surface 12. Preferably, the developer material comprises carrier granules having toner particles adhering triboelectrically thereto. Magnetic brush system 36 preferably includes two magnetic brush developer rollers 38 and 40. These developer rolls each advance the developer material into contact with the photoconductive surface 12. Each developer roller forms a chain-like array of developer material extending outwardly therefrom. The toner particles are attracted from the carrier granules to the electrostatic latent image forming a toner powder image on photoconductive surface 12 of belt 10.

Belt 10 then advances the toner powder image to transfer station D. At transfer station D, a sheet of support material 42 is moved into contact with the toner powder image. A sheet of support material is advanced to transfer station D by a sheet feeding apparatus 44. Preferably, sheet feeding apparatus 44 includes a feed roll 46 contacting the uppermost sheet of stack 48. Feed roll 46 rotates to advance the uppermost sheet from stack 42 into chute 50. Chute 50 directs the advancing sheet of support material into contact with the photoconductive surface 12 in registration with the toner powder image developed thereon. In this way, the toner powder image contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly indicated generally by the reference numeral 56, which permanently affixes the transferred toner powder image to sheet 42. Preferably, fuser assembly 56 includes a heated fuser roller 58 and a back-up roller 60. Sheet 42 passes between fuser roller 58 and back-up roller 60 with the toner powder image contacting fuser roller 58. In this manner, the toner powder image is heated so as to be permanently affixed to sheet 42. After fusing, chute 62 guides advancing sheet 42 to the decurling apparatus, indicated generally by the reference numeral 64. At this time, the sheet of support material has undergone numerous processes and very frequently contains undesired curls therein. This may be due to the various processes through which it has been subjected, or to the inherent nature of the sheet material itself. Decurling apparatus 64 bends the sheet of support materials so that the sheet material is strained to exhibit plastic characteristics. After passing through decurling apparatus 64, the sheet of support material is advanced into catch tray 66 for subsequent removal from the printing machine by the operator. The detailed structure of decurling apparatus 64 will be described hereafter with reference to FIG. 1.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 68 in contact with photoconductive surface 12. The pre-clean corona generating device neutralizes the charge attracting the particles to the photoconductive surface. The particles are then cleaned from the photoconductive surface by a rotation of brush 68 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Referring now to specific subject matter of the present invention, FIG. 1 depicts decurling apparatus 64 in greater detail. Decurling apparatus 64 removes the curls in the sheet of support material by straining the sheet of support material about a small diameter roller. The decurling apparatus is compact permitting space constraints to be optimized. Decurler 64 includes a drive belt 70 entrained about a pair of spaced rollers 72 and 74. Motor 76 rotates roller 74 in the direction of arrow 78 so as to advance belt 70 in the direction of arrow 80. The sheet of support material exiting chute 62 advances in the direction of arrow 80 as well. As the sheet of support material 42 exits chute 62, it enters a space between guide plates 82 and 84. Guide plate 82 and 84 are positioned to receive the sheet from chute 62. A rod 86 is mounted so as to be translatable in a vertical direction. In this way, rod 86 contacts belt 70 intermediate rollers 72 and 74. Thus, rod 86 is positioned in contact with belt 70 between rollers 72 and 74. Rod 86 deflects belt 70 to define a nip therebetween through the sheet of support material advances. Rod 86 is mounted on a rack and pinion assembly, indicated generally by the reference numeral 88. Rack and pinion assembly 88 includes a rack 94 having a plate assembly 98 at the lower end thereof. Plate assembly 98 contacts rod 86. A gear or pinion 92 meshes with rack 94. Knob 90 is connected to gear 92. As the operator rotates knob 90, gear 92 rotates in unison therewith. Rotation of gear 92 causes rack 94 to translate in the direction of arrow 96. Translation of rack 94 moves plate 98 in unison therewith. As plate 98 moves, the degree of penetration of rod 86 into belt 70 varies. Thus, vertical movement of plate 98 controls the penetration of rod 86 in belt 70. Another set of baffle plates 100 and 102 are located at the exit region of the nip. Baffle plates 82 and 100 are mounted pivotably on frame 104. Baffle plates 84 and 102 are fixed and do not pivot. Lead in baffle plate 109 is fixed as well. Baffle plates 82, 84 and 109 guide the sheet advancing in the direction of arrow 80 into the nip defined by rod 86 and belt 70. As the sheet advances through the nip, it bends around rod 86 so as to substantially remove any curl therein. As the sheet exits the nip defined by rod 86 and belt 70, it passes between baffle plates 100 and 102. It is thus clear that baffle plates 82, 84 and 109 are located at the entrance region to the nip while baffle plates 100 and 102 are located at the exit region to the nip. A portion of plate 98 engages the marginal regions of baffle plates 82 and 100 most closely adjacent to the nip. Thus, as plate 98 translates in the direction of arrow 96, not only does it move rod 86 in the direction of arrow 96, but it also pivots baffle plates 82 and 100 about pivot points 108 and 106, respectively. Pivot point 108 is a roller bearing supporting baffle plate 82 pivotably on frame 104. Similarly, pivot point 106 is a roller bearing supporting baffle plate 100 pivotably on frame 104.

The radius of curvature of rollers 72 and 74 is substantially equal to one another. The radius of curvature of rod 86 is less than the radius of curvature of rollers 72 and 74.

In recapitulation, it is clear that the decurling apparatus of the present invention includes a translatable rod engaging and deflecting a belt to define a nip therebetween through which the sheet of support material passes. The belt is entrained about a pair of spaced rollers. The rod is interposed between the rollers. As the belt moves, it advances a sheet of support material therewith. The sheet of support material passes through the nip, to substantially remove the curl therein. A pair of guide baffles, located at the entrance to the nip guide the sheet into the nip. The entrance guide baffles are mounted pivotably on the frame of the decurler housing. Similarly, a pair of guide baffles located at the exit of the nip are also mounted pivotably on the frame of the decurler housing. As the rod translates in a vertical direction, the baffle plates at both the exit and entrance region to the nip pivot in unison therewith. Thus, both the bend of the sheet and orientation thereof are optimized as a function of the sheet thickness, moisture content and other parameters. In this way, the sheet direction and bend are controlled to prevent sheet jams and insure that the curl is substantially removed therefrom.

It is, therefore, evident that there has been provided in accordance with the present invention, an apparatus for decurling a sheet of support material being used in an electrophotographic printing machine. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

I claim:

1. An apparatus for decurling sheet material, including:

flexible means for advancing the sheet material;

a rod positioned in contact with said flexible means to define a nip through which the sheet material advances and bends about a portion thereof;

means, positioned adjacent said flexible means, for guiding the sheet material; and means for moving said rod to adjust deflection of said flexible means in the nip to change the bending of the sheet material about said rod, said moving means moving said guiding means and said rod in unison with one another.

2. An apparatus according to claim 1, wherein said flexible means includes:

a pair of spaced rollers; and a belt entrained about said pair of rollers, said rod adapted to be interposed between said pair of rollers in contact with and deflecting said belt to define the nip through which the sheet material advances.

3. An apparatus according to claim 2, wherein said moving means pivots said guiding means to vary the orientation of said guiding means for adjusting the angle of sheet material relative to said belt in unison with translating said rod to adjust deflection of said belt in the nip.

4. An apparatus according to claim 3, wherein said guiding means includes:

a frame;

first baffle means, mounted pivotably on said frame and located adjacent one of said pair of rollers, for guiding the sheet material entering the nip; and second baffle means, mounted pivotably on said frame and located adjacent the other one of said pair of rollers, for guiding the sheet material exiting the nip.

5. An apparatus according to claim 4, wherein:

said first baffle means includes a first pair of closely spaced parallel plates between which the sheet material advances with one of said first pair of parallel plates being mounted pivotably on said frame and the other of said first pair of parallel plates being mounted stationarily on said frame; and said second baffle means includes a second pair of closely spaced, parallel plates between which the sheet material advances with one of said second pair of parallel plates being mounted pivotably on said frame and the other of said second pair of parallel plates being mounted stationarily on said frame.

6. An apparatus according to claim 5, wherein said flexible means includes means for rotating one of said pair of rollers to move the belt and thereby advance the sheet material therewith.

7. An apparatus according to claim 6, wherein said pair of rollers have substantially equal radii of curvature.

8. An apparatus according to claim 7, wherein said rod has a radius of curvature less than the radius of curvature of each of said pair of rollers.

9. A method of decurling sheet material, including the steps of:

advancing the sheet material;

positioning a rod in contact with a belt entrained about a pair of spaced rollers to define a nip therebetween through which the sheet material advances and bends with the rod being interposed between the pair of spaced rollers;

guiding the advancing sheet material with a guide baffle located adjacent the belt; and moving the rod and guide baffle in unison with one another to adjust deflection of the belt in the nip to change the bending of the sheet material about the rod and to control the orientation of the sheet material.

10. A method according to claim 9, wherein said step of moving includes the steps of:

translating the rod; and pivoting the guide baffle in unison with said step of translating the rod.

11. A method according to claim 10, further including the step of rotating one of the pair of rollers to move the belt and advance the sheet therewith.

12. A printing machine adapted to produce copies on a sheet material advancing through a plurality of processing stations in the machine including a fusing apparatus, the machine having a sheet decurling apparatus for substantially removing curl in the sheet material exiting the fusing apparatus, said sheet decurling apparatus including:

flexible means for advancing the sheet material;

a rod positioned in contact with said flexible means to define a nip through which the sheet material advances and bends about a portion of said rod;

means, positioned adjacent said flexible means, for guiding the sheet material; and means for moving said rod to adjust deflection of said flexible means in the nip to change the bending of the sheet material about said rod, said moving means moving said guiding means and said rod in unison with one another.

13. A printing machine according to claim 12, wherein said flexible means includes:

a pair of spaced rollers; and a belt entrained about said pair of rollers, said rod adapted to be interposed between said pair of rollers in contact with and deflecting said belt to define the nip through which the sheet material advances.

14. A printing machine according to claim 13, wherein said moving means pivots said guiding means to vary the orientation of said guiding means for adjusting the angle of the sheet material relative to said belt in unison with translating said rod to adjust deflection of said belt in the nip.

15. A printing machine according to claim 14, wherein said guiding means includes:

a frame;

first baffle means, mounted pivotably on said frame and located adjacent one of said pair of rollers, for guiding the sheet material entering the nip; and second baffle means, mounted pivotably on said frame and located adjacent the other one of said pair rollers for guiding the sheet material exiting the nip.

16. A printing machine according to claim 15, wherein:

said first baffle means includes a first pair of closely spaced parallel plates between which the sheet material advances with one of said first pair of parallel plates being mounted pivotably on said frame and the other of said first pair of parallel plates being mounted stationarily on said frame; and said second baffle means includes a second pair of closely spaced, parallel plates between which the sheet material advances with one of said second pair of parallel plates being mounted pivotably on said frame and the other of said second pair of parallel plates being mounted stationarily on said frame.

17. A printing machine according to claim 16, wherein said flexible means includes means for rotating one of said pair of rollers to move the belt and thereby advance the sheet material therewith.

18. A printing machine according to claim 17, wherein said pair of rollers have substantially equal radii of curvature.

19. A printing machine according to claim 18, wherein said rod has a radius of curvature less than the radius of curvature of each of said pair of rollers.

* * * * *